US007064258B2

(12) United States Patent
Mea

(10) Patent No.: US 7,064,258 B2
(45) Date of Patent: Jun. 20, 2006

(54) SHOULDER PADS FOR VIOLINS AND THE LIKE

(76) Inventor: Rogelio M. Mea, Dexter St. Base View Homes, Banay Banay, Lipa City (PH) 4217

( * ) Notice: Subject to any disclaimer, the term of this patent is extended or adjusted under 35 U.S.C. 154(b) by 0 days.

(21) Appl. No.: 10/932,554

(22) Filed: Sep. 1, 2004

(65) Prior Publication Data

US 2005/0066792 A1 Mar. 31, 2005

(30) Foreign Application Priority Data

Sep. 26, 2003 (PH) ..... 2-2003-000396

(51) Int. Cl.
*G10D 1/02* (2006.01)

(52) U.S. Cl. ..... 84/278; 84/279

(58) Field of Classification Search ..... 84/278, 84/279, 280, 281; D17/20, 99
See application file for complete search history.

(56) References Cited

U.S. PATENT DOCUMENTS 5,883,315 A * 3/1999 Kaplan et al. ..... 84/279
2004/0011182 A1* 1/2004 Ruan ..... 84/278

OTHER PUBLICATIONS

Catalog: Shar Products; Spring/Summer 1998; 3 pp.
Phillppine Industrial Design Application No. 3-2003-000327 filed Jun. 4, 2003, Published Apr. 20, 2004.
Philippine Intellectual Property Office—Formality Examination Report dated Jan. 29, 2004 for Phillippine Industrial Design Application No. 3-2003-000327.
Philippine Intellectual Property Office—Formality Examination Report dated Nov. 6, 2003 for Philippine Industrial Design Application No. 3-2003-000327.
Philippine Intellectual Property Office—Formality Examination Report dated Jul. 22, 2004 for Philippine Utility Model Application No. 2-2003-00396.

* cited by examiner

*Primary Examiner*—Kimberly Lockett
(74) *Attorney, Agent, or Firm*—Sheridan Ross P.C.

(57) ABSTRACT

The construction of a shoulder rests for violins and the like comprising a generally rectangular open top elongated body having a bottom wall, opposed longitudinal side walls and opposed transverse side walls, said opposed longitudinal side walls having a plurality of protruding lugs, each having protective rubber rests at their top ends, provided thereon, and said opposed transverse side walls having flexible arms fixedly secured near the middle portion thereof.

13 Claims, 1 Drawing Sheet

SHOULDER PADS FOR VIOLINS AND THE LIKE

This utility model relates in general to shoulder rests for stringed musical instruments, preferably violin or viola.

Musicians using violins, viola, and similar instruments suffer bruises and abrasions on their shoulder caused by rubbing movement of the instrument when in use.

It is therefore the primary object of the present utility model to provide a shoulder pad for these musical instrument which prevents lateral sliding movement of the instrument thereon during use thereby minimizing or somewhat eliminating bruises and abrasions on the user.

Still an object is to provide a shoulder pad which do not affect the sound quality of the instrument as there is s spaced between the pad and the instrument.

Another object is to provide a shoulder pad having flexible strap for securing the pad to the resonance box.

These and other object of the present utility model will be apparent upon reading the following detailed description taken in conjunction with the appended drawings, wherein.

Referring now to the several views of the drawings, wherein like reference numerals designate same parts throughout, there is shown my utility model for a shoulder pad for violins and the like generally designated as 10.

Figure 1:
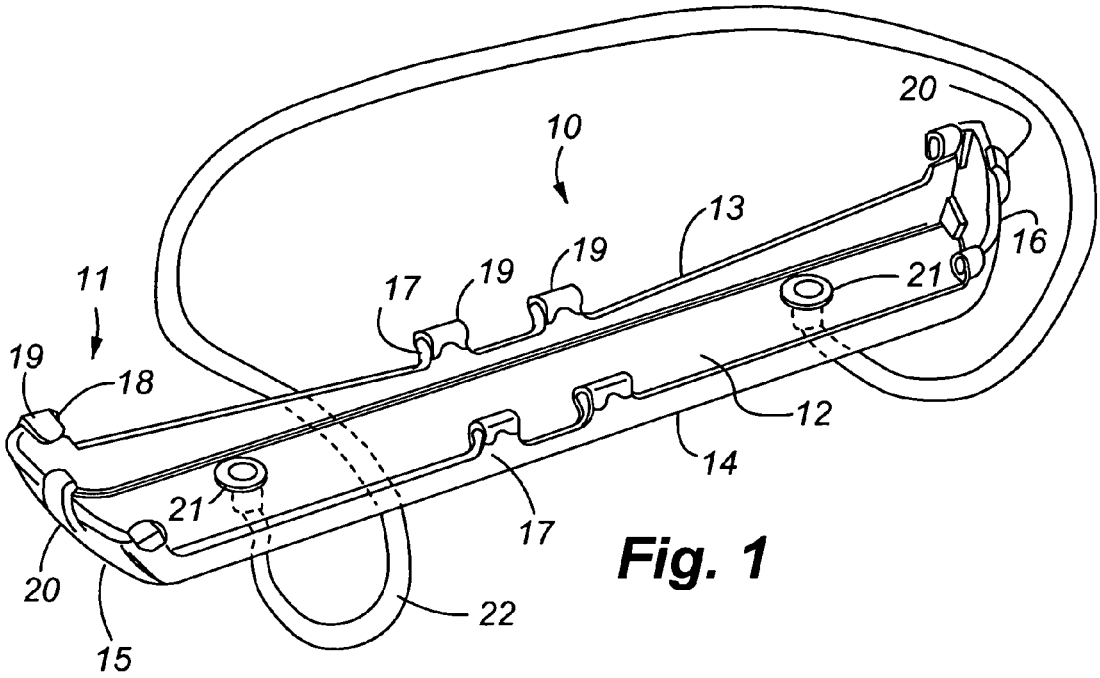
FIG. 1 is a perspective view of the shoulder pad.
Figure 2:
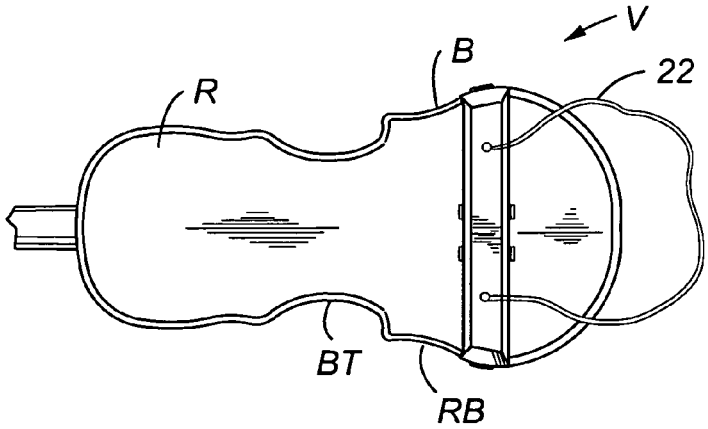
FIG. 2 is a bottom view of a violin with the shoulder pad attached thereon.

Said shoulder pad 10 being mounted against the bottom surface B near the lower end portion of the resonance box R of the violin V to protect the chest or shoulder of the user.

Said shoulder pad 10 comprises a generally rectangular open top elongated body 11 made from hard plastic material, preferably polypropylene having a bottom wall 12, opposed longitudinal side walls 13 and 14 and opposed transverse side walls 15 and 16.

Said opposed longitudinal side walls 13 and 14 each having at least a pair of upwardly protruding lugs 17 at the middle portion thereof and upwardly protruding lugs 18 near the opposed corners thereof. Each lugs 17 and 18 having protective rubber pads 19 or their equivalent at their top ends.

Said opposed transverse sidewalls 15 and 16 each having flexible arms 20 fixedly secured near the middle portions thereof.

The bottom wall 12 having at least a pair of holes 21 provided near the opposed ends thereof for connection of a flexible strap 22.

When mounted against the bottom surface B of the resonance box R, the protruding lugs 17 and 18 abuts said bottom surface B providing a space between the bottom wall 12 of the shoulder pad 10 and the resonance box R, the flexible arms 20 are clipped on the rib RB of the resonance box retaining the shoulder pad 10 on the resonance box R.

The flexible strap 22 secure the shoulder pad 10 on the bouts BT of the resonance box 10 for added securement.

I claim:

1. A shoulder pad for a violin or a viola, comprising:

a generally rectangular open top elongated body having a bottom wall, opposed first and second longitudinal side walls and opposed transverse side walls, said opposed longitudinal side walls having a plurality of protruding lugs wherein said plurality of protruding lugs are located on at least one of a first plane defined by said first longitudinal side wall and a second plane defined by said second longitudinal side wall, each of said lugs having protective pads at their top ends, and said opposed transverse side walls having flexible arms for engaging the violin or the viola.

2. The shoulder pad as claimed in claim 1 further comprising a flexible strap connected to holes provided in said bottom wall of said elongated body.

3. The shoulder pad as claimed in claim 1 wherein said elongated body, said opposed longitudinal side walls and said opposed transverse side walls being made of hard plastic material.

4. The shoulder pad as claimed in claim 2, wherein said bottom wall comprises a left end, a right end and a midpoint, and wherein a first hole of said holes is located between said right end and said midpoint, and a second hole of said holes is located between said left end and said midpoint.

5. The shoulder pad as claimed in claim 1, wherein said longitudinal side walls further comprise left ends, midpoints, and right ends, said first longitudinal side wall having a flat top edge, and said second longitudinal side wall having a top edge downwardly sloped from said left end toward said midpoint and downwardly sloped from said right end toward said midpoint.

6. The shoulder pad as claimed in claim 1, wherein said longitudinal side walls further comprise left ends, midpoints, and right ends, wherein:

a first pair of said protruding lug pairs is located proximate said left end of said longitudinal sidewalls;

a second pair of said protruding lug pairs is located proximate said right end of said longitudinal sidewalls;

a third pair of said protruding lug pairs is located between said left end and said midpoint of said longitudinal sidewalls; and a fourth pair of said protruding lug pairs is located between said midpoint and said right end of said longitudinal sidewalls.

7. The shoulder pad as claimed in claim 1, wherein said opposed transverse side walls comprise midpoints, and wherein said flexible arms are fixedly attached to said opposed transverse side walls at said midpoints.

8. The shoulder pad as claimed in claim 1, wherein said protective pads are made of rubber.

9. The shoulder pad as claimed in claim 1, wherein said opposed longitudinal side walls are substantially parallel.

10. The shoulder pad as claimed in claim 1, wherein said opposed transverse side walls are non-parallel.

11. A shoulder pad for a violin or a viola, the violin or the viola including a resonance box having a rib, the should pad comprising:

an elongated base member having a left end, a midpoint, and a right end, said base member further comprising a first hole located between said right end and said midpoint, and a second hole located between said midpoint and said left end;

opposed and substantially parallel first and second longitudinal walls fixedly attached to said elongated base member and extending upwardly therefrom, said longitudinal walls having left ends, midpoints, and right ends, said first longitudinal wall further comprising a flat top edge, and said second longitudinal wall further comprising a top edge downwardly sloped from said left end toward said midpoint and downwardly sloped from said right end toward said midpoint;

opposed non-parallel transverse side walls fixedly attached to said elongated base member and extending upwardly therefrom, said transverse side walls having midpoints, said transverse side walls further comprising flexible arms fixedly attached at said midpoint thereof for engaging the rib of the resonance box;

a plurality of protruding lug pairs fixedly disposed and symmetrically located along said longitudinal walls, wherein: a first pair of said protruding lug pairs is located at said left end of said longitudinal walls; a second pair of said protruding lug pairs is located at said right end of said longitudinal walls; a third pair of said protruding lug pairs is located between said left end and said midpoint of said longitudinal walls; and a fourth pair of said protruding lug pairs is located between said midpoint and said right end of said longitudinal walls; and a plurality of protective rubber pads fixedly attached at a top end of each said protruding lug pair.

12. The shoulder pad as claimed in claim 11, further comprising a flexible strap connected to the holes provided in said bottom wall of said elongated base member.

13. The shoulder pad as claimed in claim 11, wherein said elongated base member, said opposed longitudinal side walls and said opposed transverse side walls are made of a hard plastic material.

* * * * *